US007841027B2

(12) United States Patent
Sample

(10) Patent No.: US 7,841,027 B2
(45) Date of Patent: Nov. 30, 2010

(54) PARTITION SYSTEM

(75) Inventor: Chad Sample, Glenn Dale, MD (US)

(73) Assignee: Immediate Response Technologies, Glenn Dale, MD (US)

( * ) Notice: Subject to any disclaimer, the term of this patent is extended or adjusted under 35 U.S.C. 154(b) by 1687 days.

(21) Appl. No.: 10/892,410

(22) Filed: Jul. 16, 2004

(65) Prior Publication Data

US 2005/0011139 A1 Jan. 20, 2005

Related U.S. Application Data

(60) Provisional application No. 60/487,582, filed on Jul. 17, 2003.

(51) Int. Cl.
*A47K 3/34* (2006.01)
*A47K 3/38* (2006.01)

(52) U.S. Cl. ..... 4/615; 134/172; 239/556; 239/557; 239/565; 239/566; 160/44; 4/900; 135/902

(58) Field of Classification Search ..... 4/599, 4/601, 602, 603, 569, 570, 558, 567, 608, 4/614, 615, 900; 52/79.1, 79.4, 79.5, 137; 160/44, 135, 351, 242, 243, 330, DIG. 6; 169/48, 49, 64; 119/604, 606; 47/21.1; 135/902; 134/103.2, 103.3, 122 R, 123, 134/172, 183; 239/556, 557, 565, 566
See application file for complete search history.

(56) References Cited

U.S. PATENT DOCUMENTS 430,253 A * 6/1890 Taylor ..... 4/567
430,257 A * 6/1890 Reid ..... 4/567
439,793 A * 11/1890 Taylor ..... 4/601
699,786 A * 5/1902 Campbell ..... 4/567
803,598 A * 11/1905 Jackson ..... 4/570
833,527 A * 10/1906 Jackson ..... 4/570
1,049,714 A * 1/1913 Hersoovitz ..... 4/599
1,126,426 A * 1/1915 Eddy ..... 47/23.2
1,685,180 A * 9/1928 Sheller ..... 4/567
1,728,129 A * 9/1929 Madison ..... 4/558
1,844,038 A * 2/1932 Hooker ..... 4/599
2,005,196 A * 6/1935 Mears ..... 4/608
2,531,678 A * 11/1950 Gledhill ..... 52/2.21
2,561,265 A * 7/1951 Burns ..... 4/599
2,665,171 A * 1/1954 Stievater ..... 239/280
2,757,384 A * 8/1956 Slater ..... 4/601
2,770,244 A * 11/1956 Nathan ..... 135/88.13
2,770,812 A * 11/1956 Whiteside ..... 4/615
2,852,784 A * 9/1958 Winkler ..... 4/599
2,982,547 A * 5/1961 Carrier ..... 472/117
3,062,188 A * 11/1962 O'Day ..... 119/671

(Continued)

FOREIGN PATENT DOCUMENTS

DE 3234968 A1 * 3/1984

(Continued)

*Primary Examiner*—Robert J Canfield
(74) *Attorney, Agent, or Firm*—Duane Morris, LLP

(57) ABSTRACT

According to one embodiment of the present disclosure, a partition system includes a flexible partition expandable along at least its length and its height, at least one support element associated with the partition, and a fluid delivery system associated with the partition and configured to deliver a fluid to a space adjacent to the partition.

8 Claims, 12 Drawing Sheets

U.S. PATENT DOCUMENTS

| | | | | | |
|---|---|---|---|---|---|
| 3,080,568 | A | * | 3/1963 | Burnett | 4/602 |
| 3,179,117 | A | * | 4/1965 | Gibson | 134/107 |
| 3,332,091 | A | * | 7/1967 | Greer | 4/603 |
| 3,363,268 | A | * | 1/1968 | Friedlander | 4/506 |
| 3,431,565 | A | * | 3/1969 | Nelson | 4/598 |
| 3,483,572 | A | * | 12/1969 | Hallum | 4/597 |
| 3,606,618 | A | * | 9/1971 | Veech | 4/603 |
| 3,646,618 | A | * | 3/1972 | Johnson | 4/599 |
| 3,772,714 | A | * | 11/1973 | Sealby et al. | 4/619 |
| 3,960,216 | A | * | 6/1976 | Isobe | 169/48 |
| 3,984,879 | A | * | 10/1976 | Ejchorszt | 4/601 |
| 4,077,474 | A | * | 3/1978 | Hattori | 169/48 |
| 4,151,618 | A | * | 5/1979 | Carpenter | 5/284 |
| 4,223,477 | A | * | 9/1980 | Abernathy | 47/1.5 |
| 4,413,363 | A | * | 11/1983 | Troiano | 4/599 |
| 4,453,280 | A | * | 6/1984 | Greenleaf | 4/599 |
| 4,539,720 | A | * | 9/1985 | Westerweller | 4/599 |
| 4,675,923 | A | | 6/1987 | Ashley | |
| 4,756,258 | A | * | 7/1988 | Gilbert | 110/346 |
| 4,777,675 | A | * | 10/1988 | Letner | 4/599 |
| 4,800,597 | A | | 1/1989 | Healey | |
| 4,815,562 | A | | 3/1989 | Denny et al. | |
| 4,871,900 | A | * | 10/1989 | Hickman | 392/380 |
| 4,925,099 | A | * | 5/1990 | Owen | 239/289 |
| 4,975,992 | A | * | 12/1990 | Patterson et al. | 4/599 |
| 5,078,089 | A | * | 1/1992 | Dugan et al. | 118/687 |
| 5,097,541 | A | * | 3/1992 | Annand | 4/558 |
| RE34,042 | E | * | 8/1992 | Merino | 472/117 |
| D331,277 | S | * | 11/1992 | Murphy | D23/263 |
| 5,197,239 | A | * | 3/1993 | Glynn et al. | 52/63 |
| 5,216,763 | A | * | 6/1993 | Grenier | 4/527 |
| 5,315,721 | A | * | 5/1994 | Okun | 4/599 |
| 5,375,275 | A | * | 12/1994 | Sanders | 4/599 |
| 5,446,930 | A | * | 9/1995 | Clark | 4/599 |
| 5,469,587 | A | * | 11/1995 | Demeny | 4/599 |
| 5,564,138 | A | * | 10/1996 | Simpson | 4/599 |
| 5,722,596 | A | * | 3/1998 | Dome | 239/289 |
| 5,749,109 | A | * | 5/1998 | Kappel | 5/423 |
| 5,771,504 | A | * | 6/1998 | Steiner | 4/558 |
| 5,809,699 | A | * | 9/1998 | Joly | 52/1 |
| 5,820,472 | A | * | 10/1998 | Briggs | 472/128 |
| 5,909,969 | A | * | 6/1999 | Davison | 4/569 |
| 5,913,477 | A | * | 6/1999 | Dean | 239/289 |
| 5,920,927 | A | * | 7/1999 | Thomas | 4/599 |
| 5,953,770 | A | * | 9/1999 | Kitamura | 4/601 |
| 5,993,739 | A | * | 11/1999 | Lyon | 422/31 |
| 6,047,416 | A | * | 4/2000 | Carrier | 4/596 |
| 6,130,991 | A | * | 10/2000 | Chapman | 392/367 |
| 6,192,633 | B1 | * | 2/2001 | Hilbert | 52/2.18 |
| 6,237,614 | B1 | * | 5/2001 | Retter | 134/99.1 |
| 6,237,860 | B1 | * | 5/2001 | Ducey | 239/266 |
| 6,273,114 | B1 | | 8/2001 | Schaefer | |
| 6,390,110 | B1 | | 5/2002 | Brown | |
| 6,446,277 | B1 | | 9/2002 | Blomet | |
| 6,692,257 | B1 | * | 2/2004 | Branum et al. | 434/247 |
| 6,745,414 | B2 | * | 6/2004 | Zhou | 4/599 |
| 6,829,841 | B1 | * | 12/2004 | Edwards | 34/233 |
| 6,833,335 | B2 | * | 12/2004 | DeMott et al. | 442/94 |
| 6,996,932 | B2 | * | 2/2006 | Kruer et al. | 47/48.5 |
| 7,047,577 | B1 | * | 5/2006 | Cirilli | 4/599 |
| 7,131,236 | B2 | * | 11/2006 | Sample et al. | 52/79.5 |
| D534,306 | S | * | 12/2006 | Butler | D28/9 |
| 7,203,979 | B2 | * | 4/2007 | O'Brien | 4/599 |
| 2003/0005626 | A1 | * | 1/2003 | Yoneda et al. | 47/69 |
| 2003/0037812 | A1 | | 2/2003 | Stewart et al. | |
| 2003/0074845 | A1 | * | 4/2003 | Sample et al. | 52/63 |
| 2003/0162035 | A1 | * | 8/2003 | Talpaert | 428/432 |
| 2003/0163867 | A1 | * | 9/2003 | Zhou | 4/599 |
| 2006/0048951 | A1 | * | 3/2006 | Sundholm et al. | 169/46 |
| 2006/0242758 | A1 | * | 11/2006 | Hall | 4/601 |

FOREIGN PATENT DOCUMENTS

| | | | | |
|---|---|---|---|---|
| DE | 4008685 | A1 | * | 9/1991 |
| GB | 2105987 | A | * | 4/1983 |
| GB | 2 179 549 | | | 3/1987 |
| GB | 2 206 612 | | | 1/1989 |
| JP | 02019105 | A | * | 1/1990 |
| JP | 06113971 | A | * | 4/1994 |
| JP | 06113974 | A | * | 4/1994 |

* cited by examiner

PARTITION SYSTEM

RELATION TO OTHER PATENT APPLICATIONS

This patent application claims the benefit of U.S. Provisional Application No. 60/487,582, filed Jul. 17, 2003.

DESCRIPTION OF THE INVENTION

1. Field of the Invention

The present disclosure relates generally to a partition system and more particularly to a partition system having a fluid delivery system.

2. Background of the Invention

In some situations, partitions may be required within temporary or permanent structures. Such partitions may be used for a wide variety of applications. Existing partitions, however, may not be capable of expanding in more than one direction. Other partitions, may not be capable of delivering fluid to an area defined by the partition. Still other partitions may not be capable of conforming to the structure within which they are erected and may not be resistant to their surroundings. For example, some existing partitions may not be flame retardant, ultra-violet ray stabilized, or chem-bio resistant. As a result, some existing partitions may not meet existing building codes or other safety regulations requiring a minimum level of resistance to such elements. For example, many fire codes require flame retardancy for temporary structures in indoor locations.

The system of the present disclosure is directed to overcoming one or more of the problems set forth above.

SUMMARY OF THE INVENTION

In one embodiment of the present disclosure, a partition system includes a partition, at least one support element associated with the partition, and a fluid delivery system associated with the partition and configured to deliver a fluid to a space adjacent to the partition.

In another embodiment of the present disclosure, a method of delivering a fluid to a space includes providing a substantially flexible partition having a plurality of removable hoses in communication therewith, each of the hoses having at least one nozzle useful in delivering a fluid, slidably supporting the partition with a plurality of support elements, and expanding the partition along a length of a support member proximate to the space.

In still another embodiment of the present disclosure, a method of supplying fluid includes defining a space with a partition that is at least one of flame retardant, ultra violet ray stabilized, or chemical resistant, delivering the fluid to at least one element of the partition, and directing the fluid to the space with a plurality of dispersion mechanisms of the at least one element.

In yet another embodiment of the present disclosure, a fluid delivery partition system capable of rapidly deploying from a collapsed configuration to supply fluid to a space, the fluid delivery partition system includes a flexible partition expandable from a collapsed configuration in at least two directions, at least one support means associated with the partition to assist in the maintenance of the partition in an expanded configuration, and a fluid delivery means associated with the partition to deliver a fluid to a space adjacent to the partition.

In a further embodiment of the present disclosure, a method of rapidly delivering fluid to a space includes providing a rapidly deploying flexible partition expandable from a collapsed configuration in at least two directions and having a hose and nozzle assembly for delivering fluid to a space and support elements to assist in the maintenance of the partition in an expanded configuration, expanding the partition in at least two directions, slidably mounting the partition to a support member using the support elements, connecting the hose and nozzle assembly to a fluid source, and supplying fluid to a space adjacent to the partition through the hose and nozzle assembly.

Additional objects and advantages of this disclosure will be set forth in part in the description which follows, and in part will be obvious from the description, or may be learned by practice of the embodiments of the disclosure. The objects and advantages of the disclosure will be realized and attained by means of the elements and combinations particularly pointed out in the appended claims.

It is to be understood that both the foregoing general description and the following detailed description are exemplary and explanatory only and are not restrictive of the disclosure, as claimed.

The accompanying drawings, which are incorporated in and constitute a part of this specification, illustrate several embodiments of the disclosure and together with the description, serve to explain the principles of the disclosure.

DESCRIPTION OF THE EMBODIMENTS

Reference will now be made in detail to the exemplary embodiments of the disclosure, example of which is are illustrated in the accompanying drawings. Wherever possible, the same reference numbers will be used throughout the drawings to refer to the same or like parts.

A partition system of the present disclosure may include a partition, a fluid delivery system, and at least one support element. In some embodiments, the fluid delivery system may include at least one hose having at least one dispersion mechanism. In addition, the at least one support element may be slidably mounted to, for example, a support member.

Figure 1:
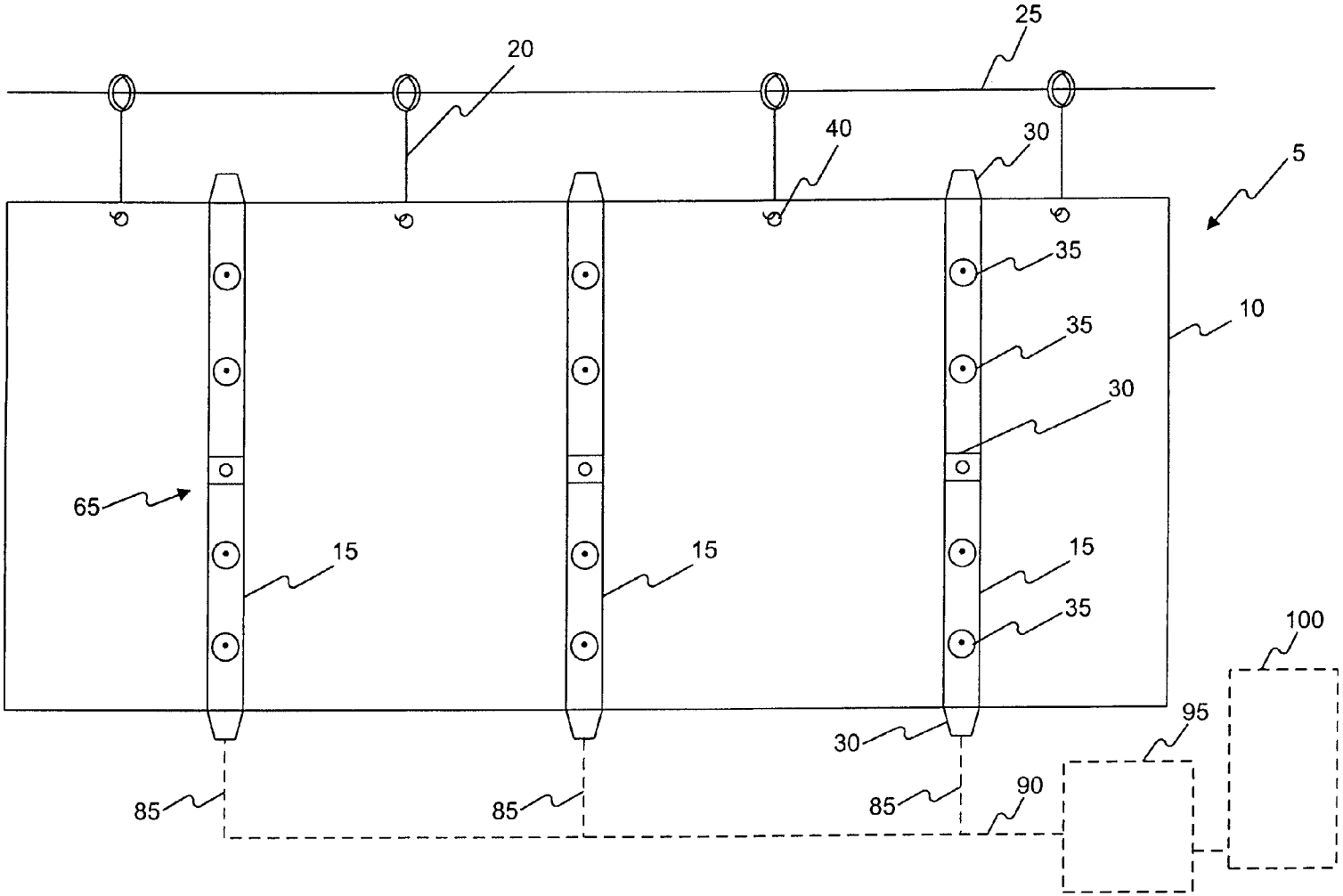
FIG. 1 is a diagrammatic illustration of a partition system according to an exemplary embodiment of the present disclosure.

FIG. 1 illustrates an exemplary embodiment of a system 5 of the present disclosure. The partition 10 may be made of any material or a combination of materials having characteristics useful in, for example, decontamination, cleaning, showering, quarantining and/or other fluid delivery applications. Such materials may include, for example, plastics, rubbers, vinyls, nylons, cloths, meshes, or any combinations, composites, or derivatives thereof known in the art. For example, in one embodiment the partition 10 may be comprised of a combination of high tensile strength nylon and polyester. The materials may be natural or synthetic and may have any desirable thickness or base weight. The materials may be chosen depending on its desired use.

In addition, the partition 10 may be coated with any material, agent, combination of materials, or combination of agents known in the art. Such coatings may impart additional desirable characteristics to the partition depending on its intended use. For example, in one embodiment, the partition 10 may be a nylon scrim having a base weight of approximately 5 ounces per square yard and may be coated on each side with polyvinylchloride. In such an embodiment, the partition 10 may be chemical resistant, biological agent resistant, ultraviolet ray/light stabilized, and/or flame retardant. While such coatings may impart one or more desirable characteristics to the partition 10, it is understood that the materials used to construct the partition may impart the same or similar characteristics. Depending on the materials and/or coatings used, the partition 10 may be transparent, semi-transparent, or opaque.

The partition 10 may be any length, height, shape, or configuration known in the art, and its overall dimensions may conform to the room, hallway, tent, wall, shelter, or other structure in which it is used. For example, in an embodiment where the partition 10 is used in a dome-shaped shelter, the partition 10 may be substantially dome-shaped. Its dimensions may also be prescribed by the application in which it is used. For example, in an embodiment where the partition 10 is used to quarantine a patient within a shelter, the partition 10 may be dimensioned to completely close off at least a section of the shelter and may be at least as tall as and/or as long as the section.

Figure 1A:
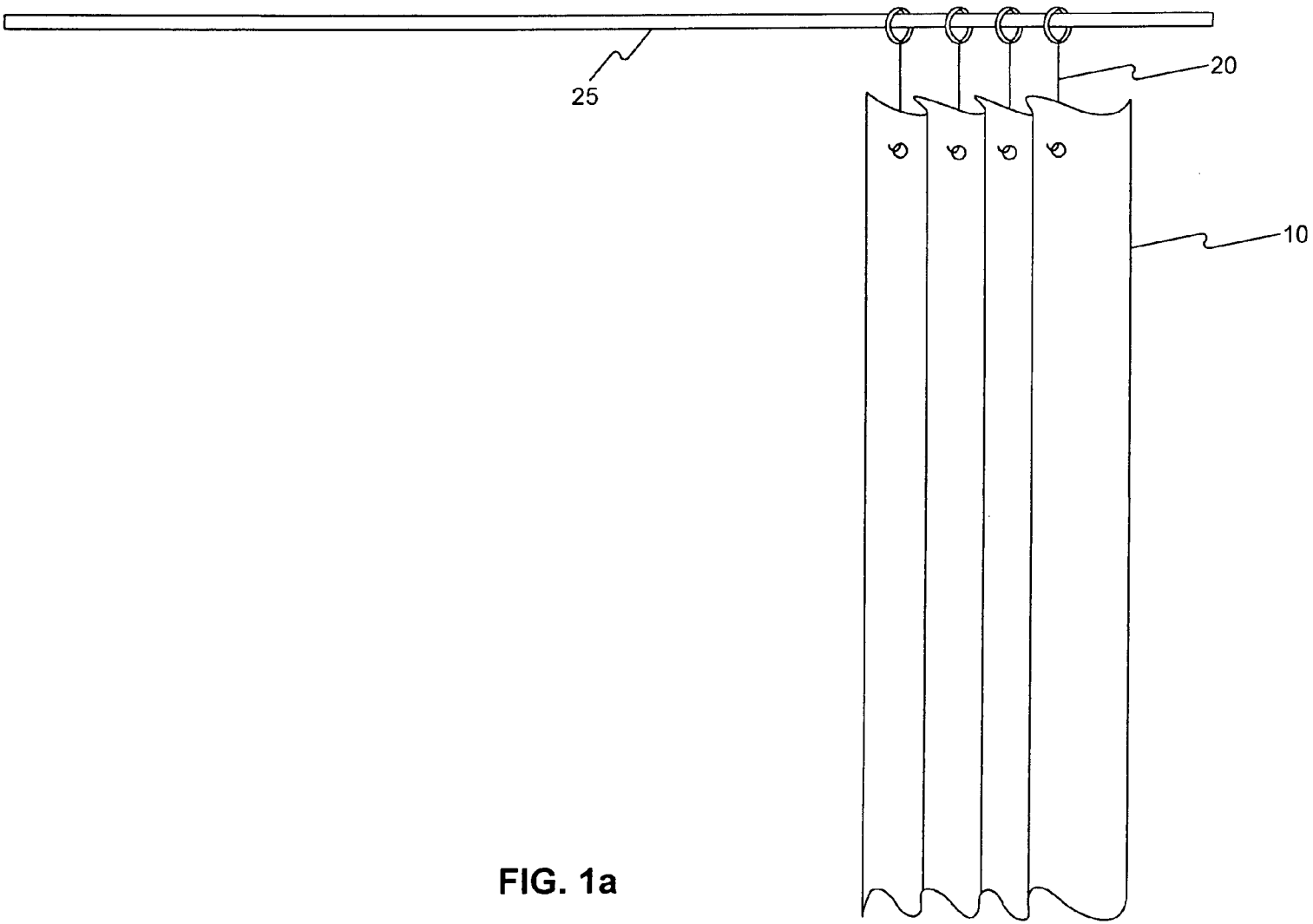
FIG. 1*a* is the partition system of FIG. 1 according to an exemplary embodiment of the present disclosure.

The partition 10 may be substantially flexible such that it may be expanded and/or collapsed in any conventional way. The partition 10 may be expandable and collapsible in all directions such as, for example, along its length and along its height. For example, in a collapsed configuration the partition 10 may be folded in a substantially accordion-like fashion. An exemplary embodiment of such a collapsed configuration is shown in FIG. 1*a*. The partition 10 may be tied, bunched, rolled, folded, or otherwise secured in place using one or more collapsing mechanisms 12 (FIG. 1*b*) to form the collapsed configuration. Alternatively, the partition may be slidably manipulated into the collapsed configuration and may remain collapsed without being secured.

Figure 1B:
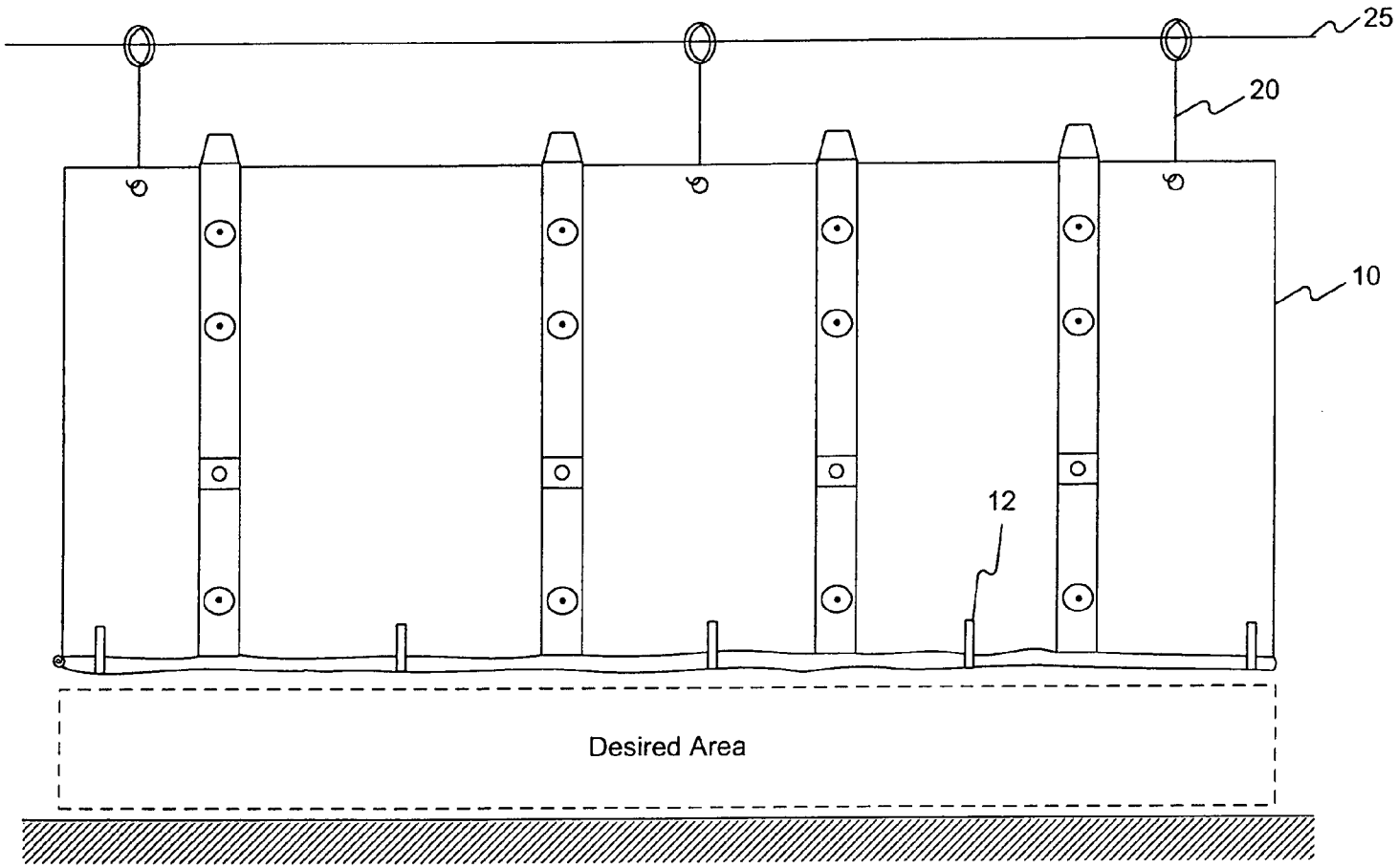
FIG. 1*b* is the partition system of FIG. 1 according to another exemplary embodiment of the present disclosure.

FIG. 1*b* illustrates a partially collapsed configuration in which the partition 10 may be collapsed along its height to span a desired vertical area or structure. To substantially conform to the desired area or structure, the height of the partition may be tailored to substantially correspond to the dimensions of the area or structure. Alternatively, the partition 10 may be tied, bunched, rolled, folded, or otherwise secured as described above. As previously mentioned, to expand and/or collapse the partition 10 along at least its length or height, the partition 10 may include one or more collapsing mechanisms 12 known in the art. Such collapsing mechanisms 12 may be any type of collapsing device useful in expanding, withdrawing, and/or securing a flexible structure. Such collapsing mechanisms 12 may be, for example, drawstrings, ties, hooks, Velcro straps, or ropes. Alternatively, in some embodiments the collapsing mechanisms 12 may be omitted.

In a substantially expanded position, the partition 10 may be substantially flat and substantially vertical. In one embodiment, the partition 10 may expand along its length to span a desired area or structure and may have a length that corresponds to the desired area or structure. FIG. 1 illustrates an exemplary expanded configuration.

Figure 6:
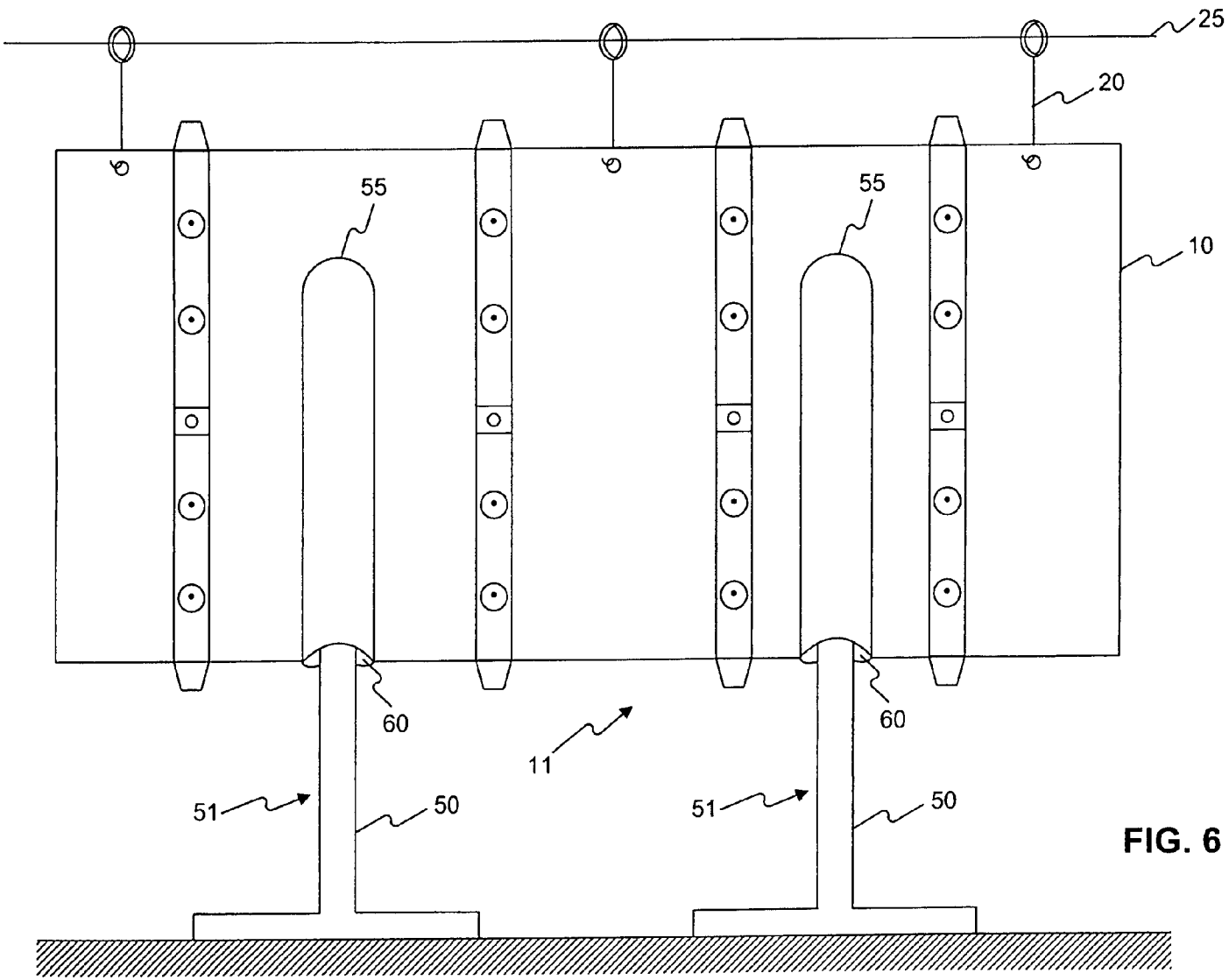
FIG. 6 is a partition according to an exemplary embodiment of the present disclosure.

In a substantially expanded position, the partition 10 may define a space 11 (FIG. 6). The space 11 may be any desirable location relative to the partition and in some embodiments of the present disclosure, the space 11 may be adjacent to the partition 10. For example, in an embodiment where only one partition 10 is used, the partition 10 may be substantially expanded to define a space 11 in front, behind, or adjacent to the partition 10. In other embodiments, however, where more than one partition 10 is used (not shown), the partitions 10 may be substantially expanded to define a space 11 that is substantially surrounded by or adjacent to one or more of the partitions 10.

The partition 10 may also be structurally stable enough to support at least one hose 15 and may be capable of supporting multiple hoses 15. As will be discussed below, the hoses 15 may be capable of delivering liquids, and/or other similar substances. Thus, the partition may be rigid enough to support the hoses 15 while the substances are being delivered and may be able to withstand the forces applied thereby. For example, in an application where the hoses 15 deliver fluid to an object located within a close proximity to the partition 10, the partition 10 may be stable enough to remain in a substantially vertical position during fluid delivery. In some embodiments, the partition 10 may include bottom supports 50 (FIG. 6) or any other support structures known in the art to facilitate a desired stability. In other embodiments, at least a portion of the partition 10 may be secured to a structure to assist in facilitating a desired stability.

Figure 5:
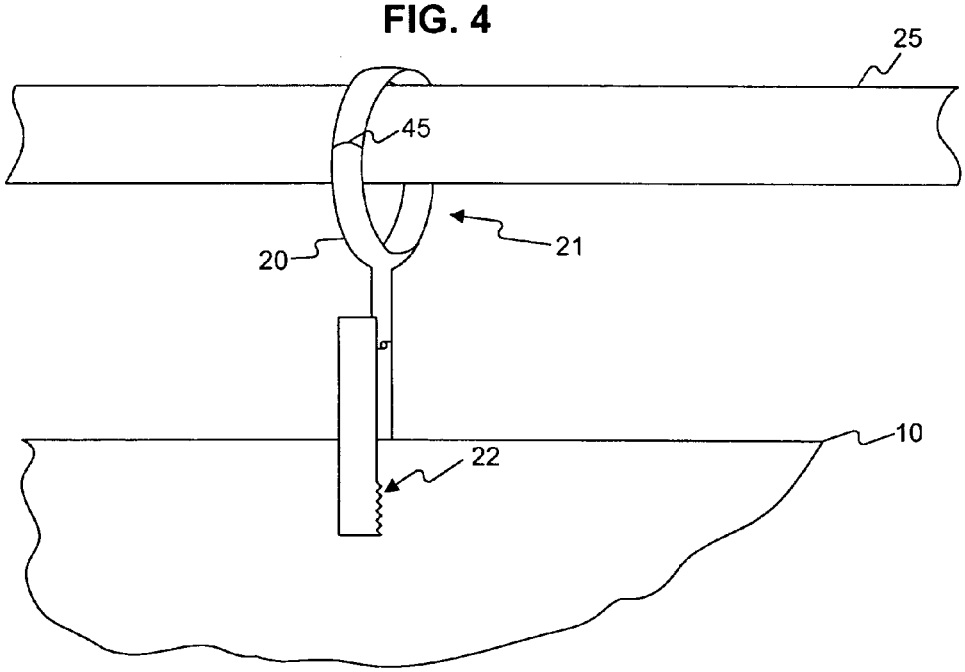
FIG. 5 is a support element according to still another exemplary embodiment of the present disclosure.
Figure 5A:
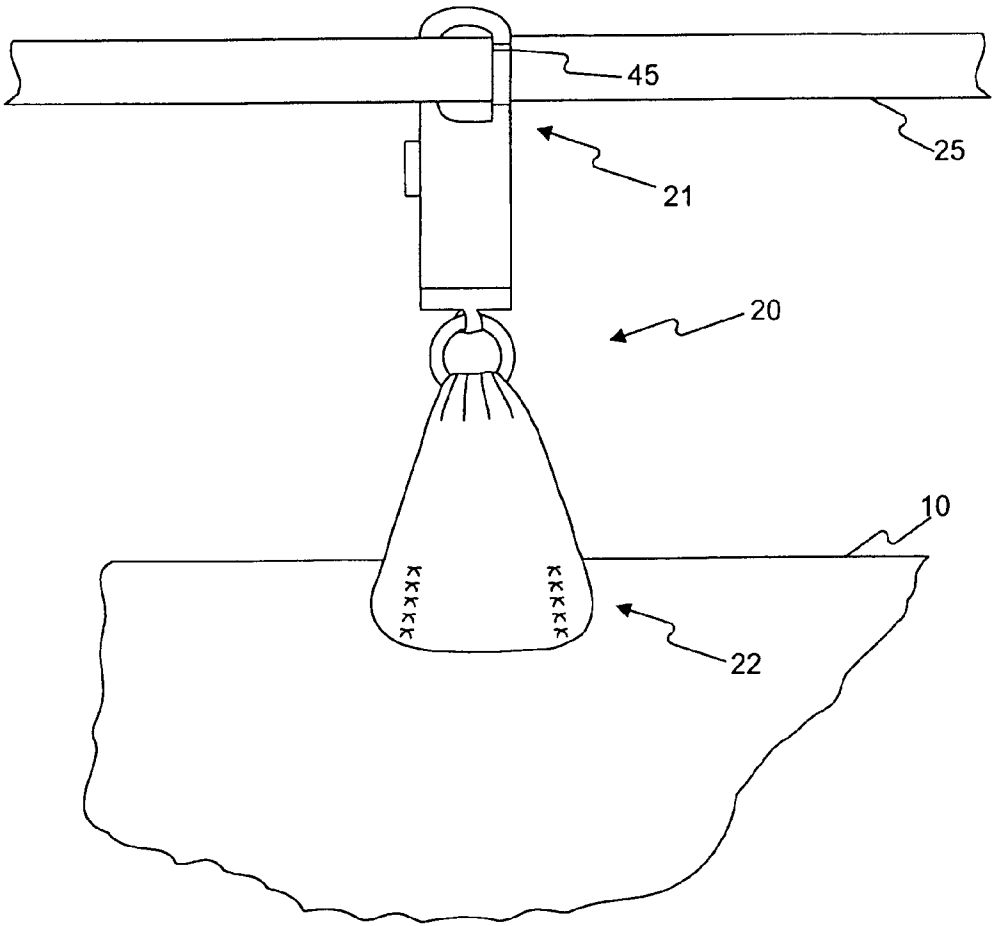
FIG. 5*a* is a support element according to a further exemplary embodiment of the present disclosure.

As shown in FIG. 1, in some embodiments the partition 10 may define a number of support orifices 40. The orifices 40 may be positioned in any configuration known in the art. For example, the orifices 40 may be located near the top and/or bottom of the partition 10 so as to facilitate hanging, draping, supporting, expanding, collapsing, moving and/or otherwise positioning the partition 10. The partition 10 may include any number of orifices 40 necessary for its support. The orifices 40 may be substantially evenly spaced along, for example, an edge of the partition 10 such that the partition's weight may be evenly distributed among the orifices 40 when the partition 10 is hung. The orifices 40 may be any shape known in the art and may be sized to accept, for example, a support element 20 or other like structure. In some embodiments of the present disclosure, the orifices 40 may include a reinforcement structure (not shown) such as, for example, a ring or other conventional means for adding strength and/or support to the orifice 40. Alternatively, as shown in FIGS. 5 and 5*a*, in other embodiments of the present disclosure the orifices 40 may be omitted.

The partition 10 may be slidably supported by support elements 20. As shown in FIGS. 1-5*a*, the support elements 20 may be supported by a support member 25. The support elements 20 may be made of any metal, plastic, rubber, polymer, or other material known in the art and may be capable of supporting at least a portion of the system 5. For example, in one embodiment, the support elements 20 may be made of high grade plastic. In addition, the support elements 20 may be of any configuration known in the art useful in supporting, for example, partitions. As will be described in greater detail below, such configurations may include, for example, rings, hooks, graspers, and/or combinations thereof. In some embodiments, the support elements may be easily and rapidly attached to and/or detached from the support member 25 and/or the partition 10. In other embodiments, they may be permanently attached to the support member 25 and/or the partition 10. In addition, the support elements 20 may be slidably connected to the support element. Thus, when the partition 10 is expanded the support elements 20 may slide in one direction along the support member 25 and when it is collapsed the support elements 20 may slide in the opposite direction along the support member 25.

Figure 2:
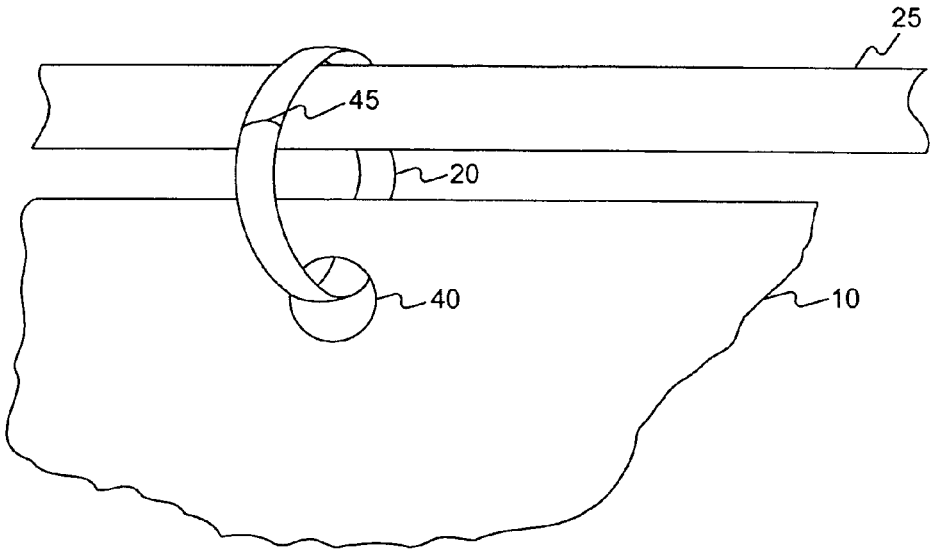
FIG. 2 is a support element according to an exemplary embodiment of the present disclosure.

FIG. 2 shows an exemplary embodiment of a support element 20 of the present disclosure. In this embodiment, the support element 20 may be, for example a ring, loop, or other like continuous structure. As shown in FIGS. 2, 3, 5 and 5*a* the support elements 20 may include a break 45 to facilitate attachment to and/or detachment from, for example, the support member 25. The support elements 20 may be partially separated or opened at the break 45 for entry onto the support member 25. While a support element 20 is partially separated or opened, at least a portion of the element 20 may also pass through a support orifice 40 of the partition 10. The support element 20 may be re-closed at the break 45 to again form a continuous structure. Alternatively, in some embodiments, the break 45 may be omitted.

Figure 3:
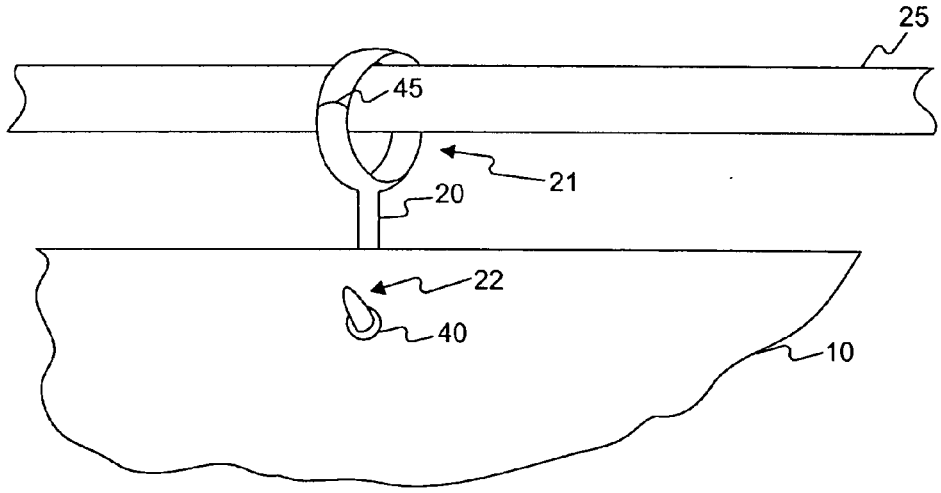
FIG. 3 is a support element according to another exemplary embodiment of the present disclosure.

As FIG. 3 illustrate, in some embodiments the support elements 20 may include a loop portion 21 and a support portion 22. The loop portion 21 may be continuous or closed, and may include a break 45 as described above. The loop portion 21 may be configured to open, close, or be otherwise moveable at the break with the assistance of a spring or other like structure. The loop portion 21 may be in communication with the support member 25 such that the support member 25 bears any load and/or other force applied by the support element 20. Such loads may be, for example, at least a portion of the mass of the object being supported by the support element 20. Other loads may be, for example, the entire mass of the object. In embodiments where the support elements 20 include a break 45, the support elements 20 may be capable of supporting such a load without opening at the break 45. As described above, the loop portion 21 may be slidably connected to the support member 25 so as to facilitate the expansion and/or collapse of the partition 10.

The support portion 22 may be of any configuration known in the art such as, for example, a hook, prong, loop, concentric wire, gripper, flat piece of material, spring loaded structure, key ring-style structure, clothespin-style structure, and/or a combination thereof. As shown in FIG. 3, at least a portion of the support portion 22 may pass through the partition 10. In some embodiments, the support orifices 40 may accept the support portions 22 of the support elements 20. In such embodiments, the support portions 22 may contact and/or support the partition 10 at the support orifices 40. In embodiments where the support elements 20 include a support portion 22, the support elements 20 may be a one-piece configuration or, alternatively, may be made of more than one piece. In such embodiments, the support portion 22 may be made from the same or different materials as the loop portion 21 and the support portion 22 may be substantially rigid to as to support at least a portion of the mass of the object being supported by the support element 20 as described above, and may be sufficient to support the entire mass.

Figure 4:
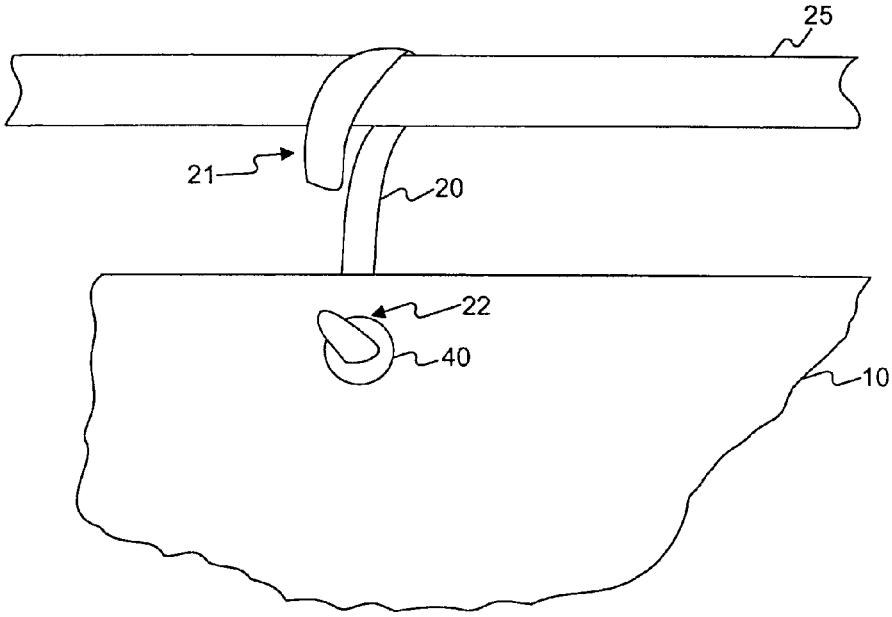
FIG. 4 is a support element according to yet another exemplary embodiment of the present disclosure.

As shown in FIG. 4, in some embodiments the loop portion 21 may be substantially open and, thus, the support element 20 may be discontinuous. Such embodiments may allow for rapid engagement and disengagement between the support elements 20 and the support member.

In other embodiments of the present disclosure, the support portion 22 may not pass through the partition 10. In such embodiments, the support portion 22 may be a clothespin-style structure, a gripper, or any other like structure known in the art. FIG. 5 illustrates such an embodiment. In embodiments where the support portion 22 does not pass through the partition 10, the portion 22 may include any compression, adhesive, and or other connecting means known in the art to be useful for gripping, securing, supporting, and/or otherwise immobilizing a structure. The compression force applied by the support portion 22 may be sufficient to support at least a portion of the mass of the object being supported by the support element 20, and may be sufficient to support the entire mass.

Alternatively, as shown in FIG. 5*a*, at least a portion of the support portion 22 may be stitched, glued, heat sealed, or otherwise attached to the partition and may allow for the support of the partition via a spring loaded or other type of loop portion 21. In such embodiments, the support orifice 40 may be omitted. In addition, although FIGS. 5 and 5*a* show the a support element 20 having a substantially closed loop portion 21, it is understood that in embodiments where the support portion 22 does not pass through the partition 10, the loop portion 21 may be substantially open as described above.

As shown in FIGS. 1-5*a*, and as described above, the support elements 20 may be slidably connected to the support member 25. The support member 25 may be any structure known in the art capable of supporting at least a portion of the partition 10. The support member 25 may be substantially horizontal or, alternatively, may have portions positioned in any direction relative to the partition 10. The support member 25 may be any shape known in the art. For example, in one embodiment, the support member 25 may be substantially straight. In other embodiments, the support member 25 may be curved, bent, angled, or otherwise configured depending on the application and/or the desired configuration of the partition 10. It is understood that the partition 10 may substantially conform to the configuration of the support member 25.

The support member 25 may have any cross-sectional shape known in the art. For example the support member 25 may have a cross-section that is round, ovular, square, L-shaped, C-shaped, rectangular, and/or I-shaped, and may be solid or hollow. In some embodiments, the support member may be, for example, a rod, cable, wire, string, tube, channel, or bar, and may be an element of the structure in which the system 5 is being used. For example, in one embodiment, the support member 25 may be an interior rod of a tent structure.

As mentioned above, FIG. 6 illustrates another embodiment of the present disclosure in which the system 5 may include one or more bottom supports 50. The bottom supports 50 may be any type of free-standing support known in the art and may rest on and be supported by a substantially horizontal surface. The bottom supports may be made of any material known in the art and may be substantially immobile relative to the partition 10.

As shown in FIG. 6, the bottom supports 50 may include a substantially vertical portion 51. The vertical portion 51 may be sized according to the size of the partition 10. In some embodiments, the vertical portion 51 may be extendable and/or retractable and, thus, may have a varying length. The vertical portion 51 may support at least a portion of the partition 10 and may restrict the movement of at least a portion of the partition 10. In some embodiments, the vertical portion 51 may substantially immobilize the at least a portion of the partition 10.

The bottom supports 50 may be connected to the partition 10 by any conventional means known in the art. For example, as shown in FIG. 6, the partition may include a number of support sleeves 55. The support sleeves 55 may be integral the partition 10. As used herein, the term "integral" means made from at least a part of, or otherwise formed together in a substantially unitary construction. Alternatively, the support sleeves 55 may be sewn, heat sealed, glued, or otherwise attached to the partition 10. The support sleeves 55 may be permanently attached to the partition 10 as described above or, alternatively, at least a portion of the support sleeves 55 may be repeatably attachable to and/or detachable from the partition 10. The at least a portion of the support sleeves 55 may include Velcro or other like substance to facilitate the repeatable attachment and/or detachment. In such embodiments, the partition 10 may include a corresponding Velcro or other like substance in corresponding locations for mating with that of the support sleeves 55.

The support sleeves 55 may define a channel 60. Each channel 60 may accept at least a portion of a bottom support 50 and may be sized to accept at least a portion of the vertical portion 51 of a bottom support 50. At least one end of the support sleeves 55 may be open. Alternatively, both ends of the support sleeves 55 may be open.

Referring again to FIG. 1, the fluid delivery system 65 of the present disclosure may include at least one hose 15 having at least one dispersion mechanism 35. The hoses 15 may be positioned substantially vertically along the partition 10. In such an embodiment, the hoses 15 may have a length that is greater than, less than, or equal to the height of the partition 10. Alternatively, the hoses 15 may be positioned substantially horizontally along the partition 10. In such an embodiment, the hoses 15 may have a length that is greater than, less than, or equal to the length of the partition 10.

Figure 7:
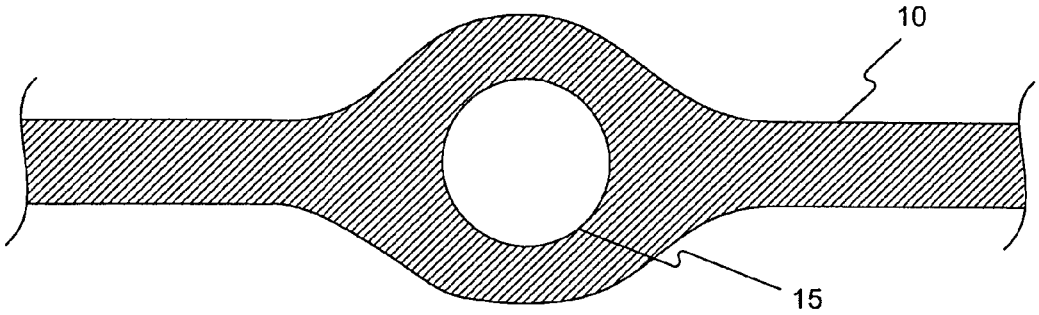
FIG. 7 is a cross-sectional view of a hose according to an exemplary embodiment of the present disclosure.

The hoses 15 may be fixedly or removably attached to the partition 10. In the fixed configuration, the hoses 15 may be integral the partition 10. In such an embodiment, the hoses 15 may be one or more channels within the partition 10 capable of delivering a desired amount of fluid. FIG. 7 illustrates a cross-sectional view of the partition 10 in an embodiment in which a hose 15 is integral the partition. Although shown as substantially circular, it is understood that such a hose may have any cross-sectional shape known in the art such as, for example, rectangular, oblong, square, or D-shaped. As used herein, the term "fluid" means any solid, liquid, slurry, agent, and/or combination thereof.

Figure 8:
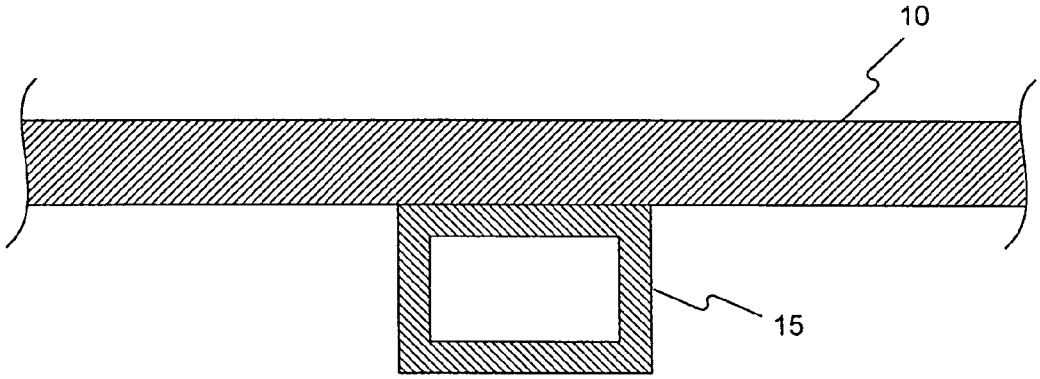
FIG. 8 is a cross-sectional view of a hose according to another exemplary embodiment of the present disclosure.
Figure 9:
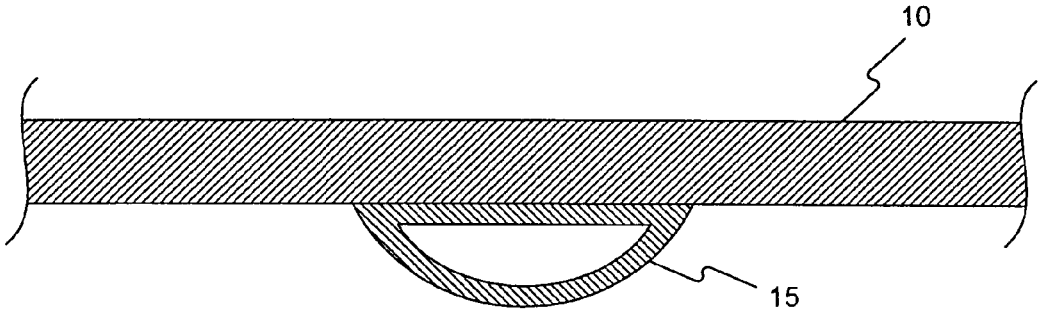
FIG. 9 is a cross-sectional view of a hose according to still another exemplary embodiment of the present disclosure.

In other embodiments of the fixed configuration, the hoses 15 may be formed separately and permanently joined to the partition. Such hoses 15 may include at least one layer and may be formed of any materials known in the art, such as rubbers, plastics, metal meshes, air-tight fabrics, vinyls, polymers, and/or combinations thereof. FIG. 8 illustrates a cross-sectional view of the partition 10 having a hose 15 permanently joined thereto. Although FIG. 8 shows a hose 15 having a substantially rectangular cross-section, it is understood that such hoses may have any cross-sectional shape as explained above. For example, as illustrated in FIG. 9, the hoses 15 may have a substantially D-shaped cross-section. The hoses 15 may have an inner diameter suitable for delivering a desired amount of fluid. The one or more layers of the hoses 15 may also have wall thicknesses typical of fluid delivery system hoses such that the hoses 15 may be capable of delivering fluids at a wide range of pressures for extended periods of time. For example, in one embodiment of the present disclosure, the hoses may deliver water to a space proximate to the partition 10 at a pressure of approximately 40 pounds per square inch.

Such hoses 15 in the fixed configuration may be joined to the partition 10 by any conventional means. For example, the hoses 15 may be heat sealed or sewn to the partition 10. As another example, the hoses 15 may be attached with mechanical fasteners, compression rings, adhesives, or other means. The permanent connection between the hoses 15 and the partition 10 may be sufficient to support the hoses 15 while the hoses 15 are filled with fluid and during fluid delivery.

Figure 10:
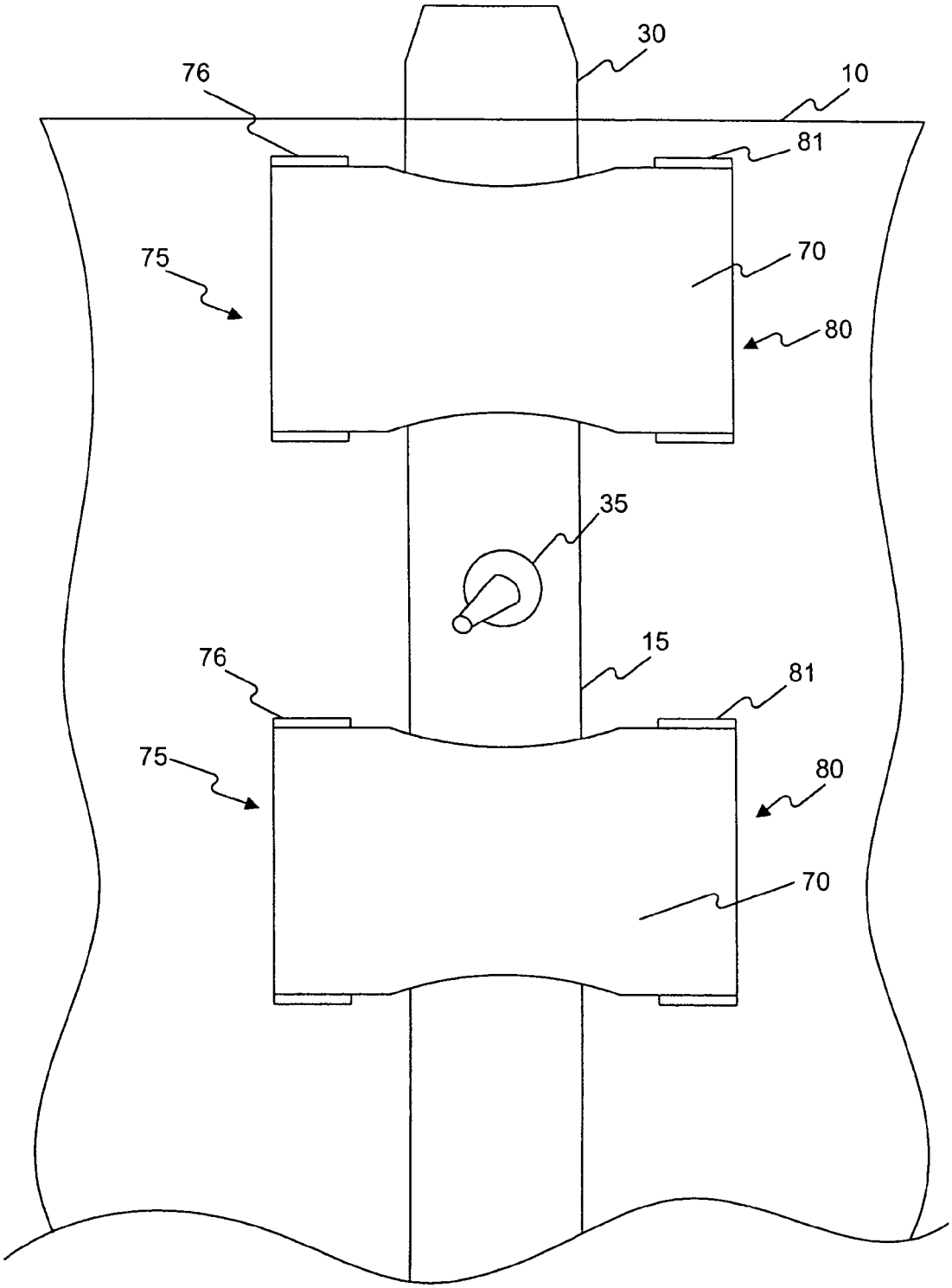
FIG. 10 is a plan view of a hose according to a further exemplary embodiment of the present disclosure.

Alternatively, in the removable configuration the hoses 15 may be secured behind one or more flaps 70 of the partition 10. As shown in FIG. 10, a first portion 75 of the flap 70 may be fixedly attached to the partition and a second portion 80 may be removably secured to the partition 10. The partition 10 may include any number of flaps 70 required to secure, support, and/or immobilize the hoses 15 during operation. The flaps 70 may be sized according to the outer diameter of the hoses 15 when the hose is fully expanded. In addition, the flaps 70 may be positioned so as not to interfere with one or more elements of the hoses 15. The flaps 70 may be made from the same or like materials as the partition 10.

The first portion 75 may be attached by any permanent connection means 76 known in the art, such as permanent adhesives, weldments, heat seals, stitching, or other like means. Alternatively, the flap 70 may be a part of the partition 10. The second portion 80 may be secured to the partition 10 by any temporary connection means 81 known in the art such as Velcro, ties, mechanical fasteners, magnetic fasteners, and adhesives. It is understood that in some embodiments of the removable configuration, the first and second portions 75, 80 may both be removably secured to the partition 10 and means 76, 81 may both be temporary connection means.

Figure 10A:
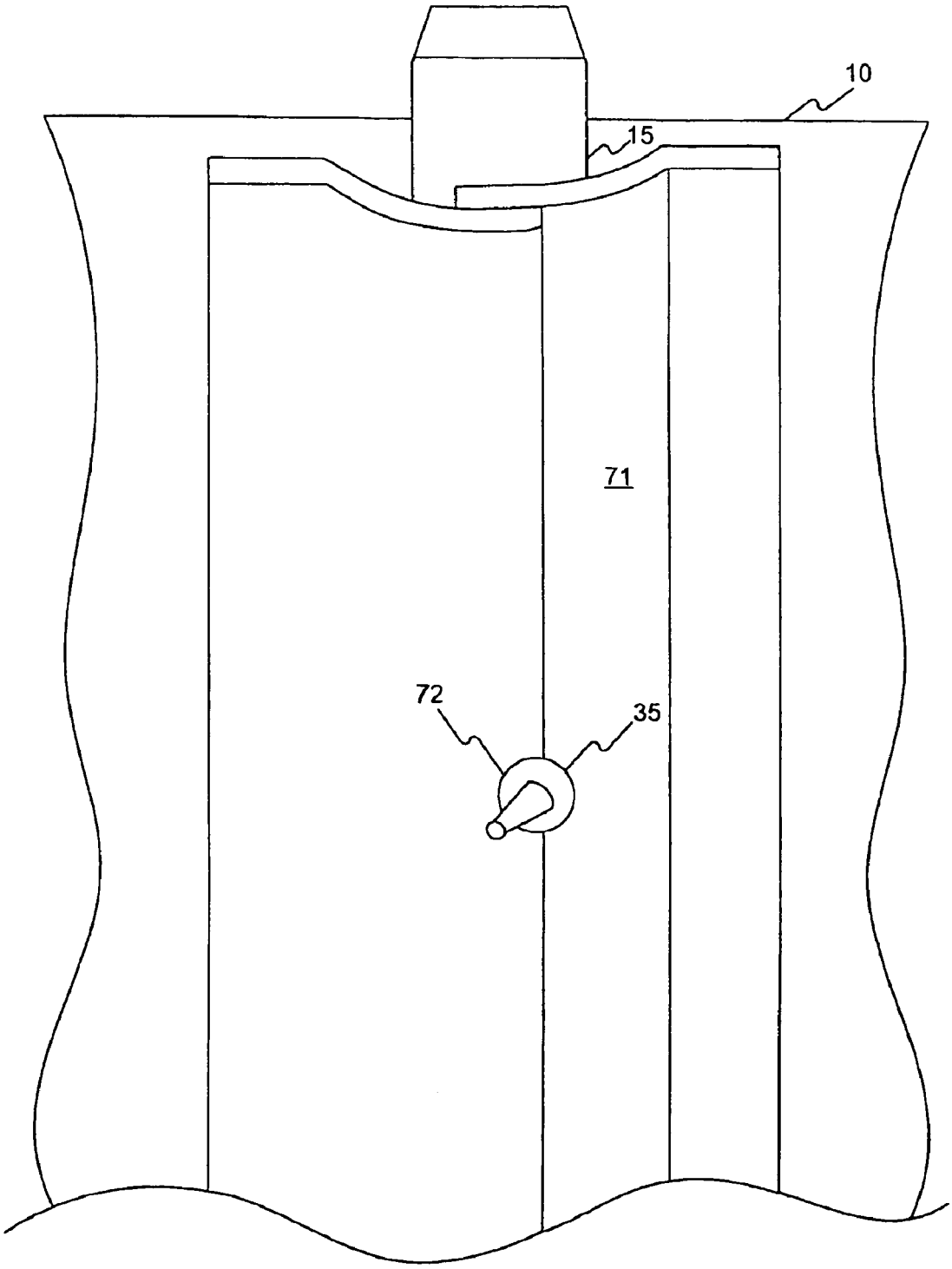
FIG. 10*a* is a plan view of a hose sleeve according to an exemplary embodiment of the present disclosure.

In another embodiment, each hose 15 may be substantially completely enclosed within a hose sleeve 71. As shown in FIG. 10*a*, at least a portion of the hose sleeve 71 may be sewn, heat sealed, adhered, or otherwise fixedly attached to a surface of the partition 10. As described above with respect to the flaps 70, the hose sleeve 71 may be sized according to the outside diameter of the hoses 15 when the hose is fully expanded and may define a number of nozzle orifices 72 to accept the corresponding dispersion mechanisms 35 of the hose 15. The hose sleeves 71 may be repeatably opened and closed by temporary connection means known in the art such as, for example, Velcro, ties, mechanical fasteners, magnetic fasteners, and adhesives. This temporary connection may facilitate the rapid installation and removal of the hoses 15. For example, an application may require the use of a particular type or style of hose 15 that is different from the hose currently located in the hose sleeve 71. The exemplary embodiment of the hose sleeve 71 shown in FIG. 10*a* may facilitate the rapid removal of a first hose and installation of a second hose in such applications.

In yet another embodiment, the hoses 15 may be removably secured directly to a surface of the partition 10. In such an embodiment, the hoses 15 may include a temporary connection means like the means described above or any other known structure for removably securing objects: Such means may include, for example, Velcro straps, hook and loop fasteners, and corresponding male/female connectors.

In both the fixed and the removable configurations, the connection between the hoses 15 and the partition 10 may also allow the partition 10 to be easily moved between the expanded position and the collapsed position described above. The hoses 15 may be flexible and collapsible such that they may collapse when empty and expand when at least partially full.

As shown in FIG. 1, the hoses 15 may include at least one valve 30. The number of valves 30 required on each hose may vary based on the application for which the system 5 is being used and the desired amount of fluid to be delivered. The valves 30 may be located at the ends of the hoses 15 and/or along the length of the hoses 15. These locations may facilitate connection with a fluid supply line 85. Each hose 15 may connect to a distinct fluid supply line 85 through a valve 30. The valves 30 may be any type of flow valve 30 known in the art. For example, the valves 30 may be quick disconnect-type valves, poppet valves, check valves, or other valve assemblies and may permit a proper flow of fluid into and out of the hoses 15. The valves 30 may also prohibit a reverse flow of fluid through the hoses 15. The valves 30 may open, close, or be otherwise actuated by hand or automatically. Alternatively, the valves 30 may be controlled remotely and may thus include a motor, a solenoid, or other like device (not shown) to facilitate this actuation. In some embodiment, the valves 30 may be omitted.

In addition, each hose 15 may further include at least one dispersion mechanism 35. The dispersion mechanisms 35 may be, for example, any type of injector, nozzle, end effector, or other structure capable of distributing fluid in a controlled manner. The dispersion mechanisms 35 may be positioned anywhere along the length of the hoses 15. For example, in one embodiment of the present disclosure, the dispersion mechanisms 35 may be substantially evenly distributed along the length of each hose 15 for a substantially even distribution of fluid. The dispersion mechanisms 35 may be of any shape or size and, in some embodiments, may be sized so as not to interfere with the expansion and/or collapse of the partition 10. In some embodiments, at least a portion of the dispersion mechanisms 35 may be flexible and/or collapsible. In other embodiments, the dispersion mechanisms 35 may be substantially flat, thereby causing minimal interference with the partition 10 in a collapsed configuration. In still other embodiments, the dispersion mechanisms 35 may be configured to allow the user to aim at least a portion of the flow delivered by the hoses 15. In further embodiments, each dispersion mechanism 35 may be individually adjusted to control the volume of fluid delivered. The dispersion mechanisms 35 may open, close, partially open or close, or be otherwise actuated by hand or automatically. Alternatively, the dispersion mechanisms 35 may be controlled remotely and may thus include a motor, a solenoid, or other like device (not shown) to facilitate this actuation.

The partition 10 may be used in a range of applications, including, for example, military, medical, fire and rescue, commercial, government, and/or consumer applications. For example, in some embodiments, the partition 10 may be used in decontamination applications associated with emergencies and/or accidents, such as, chemical spills, radiation leaks, or other events. Other applications may include decontamination in response to military or terrorist attacks involving chemical, radioactive, and/or bio-hazardous materials. The partition 10 may also be used for many non-emergency applications such as, for example, periodic cleaning and/or decontamination of workers and/or equipment.

In addition, the partition 10 may be used to divide a tent or other temporary structure used in treating patients on the field of battle. In some embodiments, the partition 10 may assist in quarantining the patient during surgery, recovery, or other treatment. In other embodiments, the partition 10 may assist in forming a barrier in a shower facility or structure. In further embodiments, the partition 10 may be used in commercial applications such as, for example, periodically cleaning and/or decontaminating workers and/or equipment, and temporarily closing-off or forming temporary spaces within indoor staging areas, such as banquet halls, auditorium, and other like places. It is understood that applications for the system of the present disclosure other than those listed herein are also envisioned.

Figure 11:
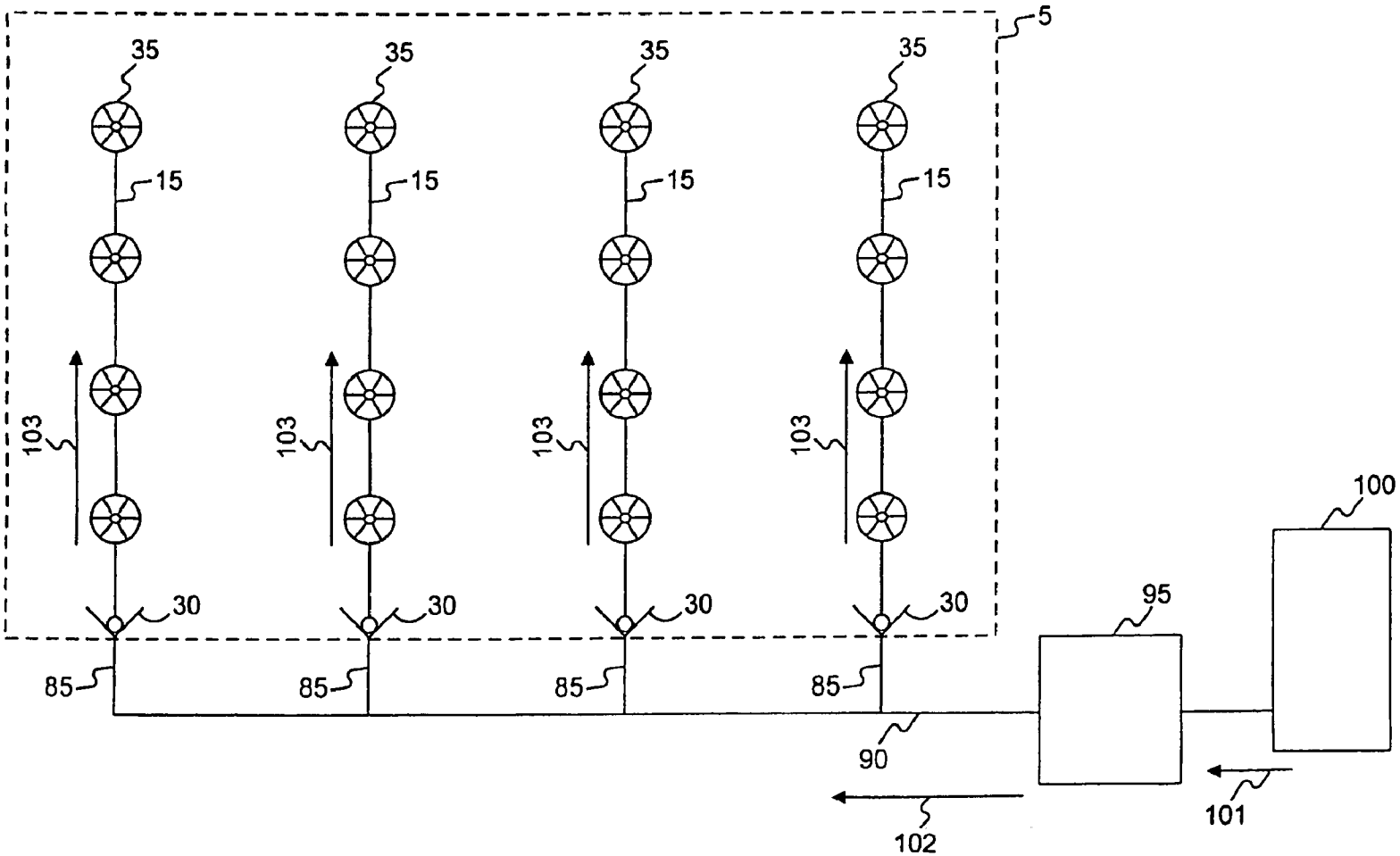
FIG. 11 is a front view diagrammatic illustration of the partition system of FIG. 1 in an open-loop configuration.

As shown in FIG. 11, in many of these applications fluid may be supplied to the system 5 from a fluid supply 100. In this embodiment, the system 5 may be an open loop system in which none of the fluid supplied to the system 5 may return to the fluid supply 100. The fluid supplied may be, for example, any type of liquid, foam, agent or combination thereof known in the art. For example, in one embodiment, the fluid may include water and/or one or more chemicals. The fluid may assist in, for example, decontaminating and/or cleaning an object and may otherwise desirably act on the object depending on the application. The fluid may be drawn from the fluid supply 100 as illustrated by flow arrow 101 by a pump assembly 95 or other like device. The pump assembly 95 may be, for example, a variable displacement pump coupled to an electric motor, and may be capable of delivering a variable amount of fluid to the system 5 based on a desired flow volume and/or rate. The pump assembly 95 may deliver the fluid to one or more hose extensions 85 through a supply line 90. This supply flow of fluid is illustrated by flow arrow 102. It is understood that in some embodiments, the pump assembly 95 may deliver fluid directly to one or more of the hoses 15.

Before entering each hose 15, the fluid may pass through a valve 30 disposed in the respective hose 15. As shown in FIG. 11, these valves 30 may be positioned or otherwise configured to permit or restrict flow to each individual hose 15. Upon entering the hoses 15, the fluid may flow in the direction of flow arrow 103. The fluid may be desirably released from the hoses 15 by one or more dispersion mechanisms 35 disposed therein.

Each hose 15 may include one or more additional valves 30 (not shown) disposed between each dispersion mechanism 35. Such valves 30 may assist in controlling the flow of fluid within the hoses 15 and may enable the user to direct flow to one or more of the dispersion mechanisms 35 while restricting flow to other dispersion mechanisms 15. Such valves 30 may also facilitate a connection between the respective hose 15 and the supply line 90, or a hose extension 85, for the delivery of fluid. Although not shown in FIG. 11, it is understood that in some embodiments the supply line 90 and/or the hose extensions 85 may also include one or more valves for controlling the flow of fluid.

Figure 12:
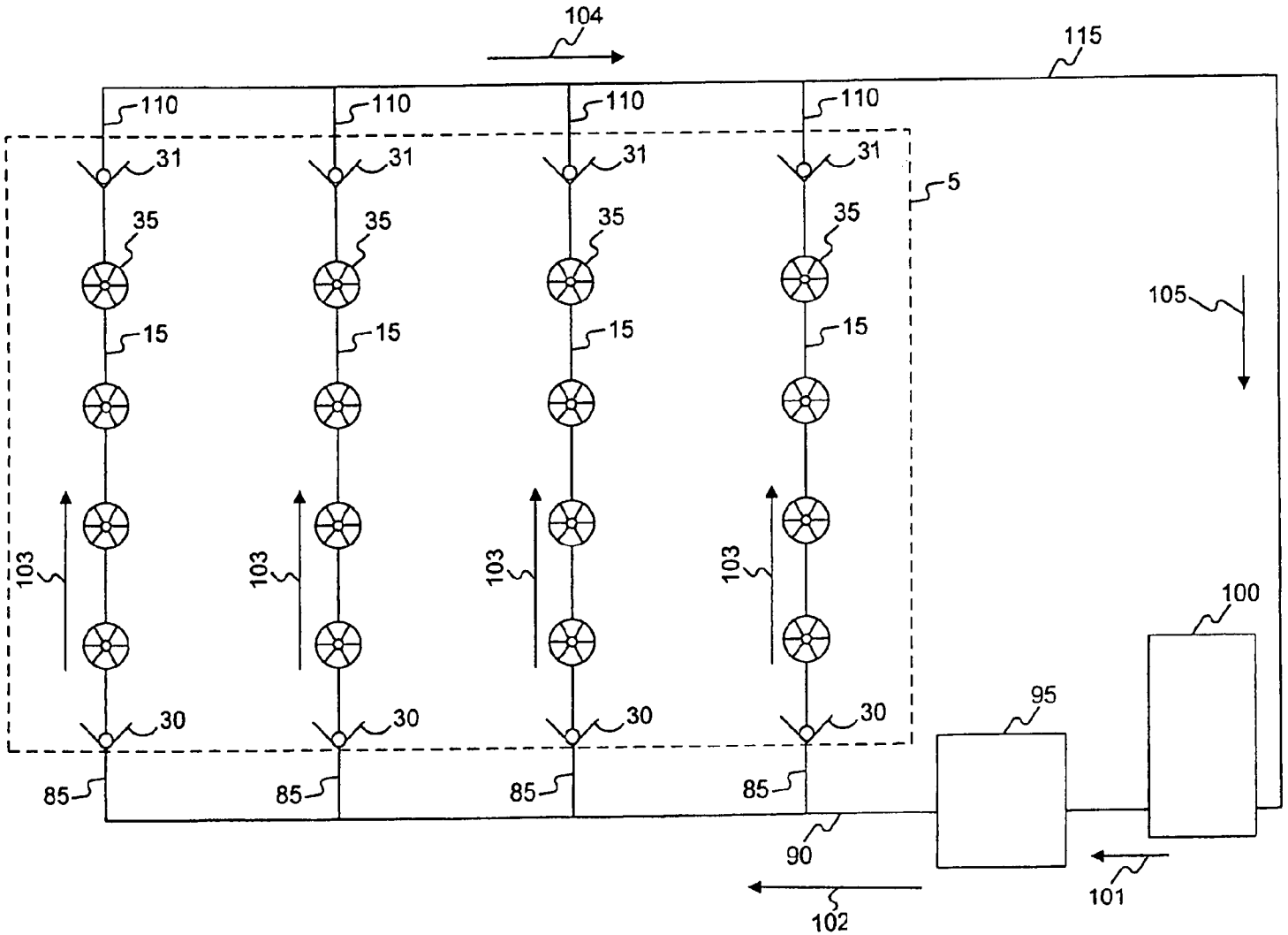
FIG. 12 is a front view diagrammatic illustration of the partition system of FIG. 1 in a closed-loop configuration.

FIG. 12 illustrates another embodiment of the present disclosure in which the system 5 is a closed loop system. In such embodiments, at least a portion of the fluid supplied to the system 5 may be returned to the fluid supply 100. As shown by flow arrow 101-103, the flow of fluid into at least a portion of the system 5 of FIG. 12 may be the same as that described above with respect to FIG. 11.

As shown in FIG. 12, each hose 15 may further include a check valve 31. The check valves 31 may include a spring or other like mechanism that biases the valve 31 in the closed position during normal operation such that while fluid is being delivered by the dispersion mechanisms 15 the valves 31 may remain closed and thereby prohibit the flow of fluid into return line extensions 110. If the pressure within a hose

15 rises above that of the closing pressure exerted by the biasing spring of the check valve 31, the check valve 31 may at least partially open and allow fluid to flow into a return line extension 110. The fluid may then flow through a return line 115 in the direction of flow arrow 104 and may return to fluid supply 100. This return flow is illustrated by flow arrow 105.

Other embodiments of the disclosure will be apparent to those skilled in the art from consideration of the specification and practice of the disclosure discussed herein. It is intended that the specification and examples be considered as exemplary only, with a true scope and spirit of the disclosure being indicated by the following claims.

What is claimed is:

1. A partition system, comprising:

a flexible partition expandable along at least its length and its height;

at least one support member;

at least one support element associated with the partition;

a fluid delivery system associated with the partition and configured to deliver a fluid to a space adjacent to the partition;

said at least one support member and at least one support element configured to allow translational movement along the support member of a portion of the partition proximate to the support element as the partition expands horizontally; and, said fluid delivery system comprising a plurality of fluid channels and a plurality of dispersion mechanisms, wherein each of the fluid channels is attached to and configured to provide fluid to at least one of the plurality of dispersion mechanisms, wherein at least one of the plurality of fluid channels is removably attached to the partition.

2. A method of delivering fluid to a space, comprising:

providing a substantially flexible partition having a plurality of removable hoses directly attached thereto, each of the hoses having at least one nozzle useful in delivering a fluid;

slidably supporting the partition with a plurality of support elements; and expanding the partition along a length of a support member proximate to the space.

3. The method of claim 2, wherein the partition is at least one of flame retardant, ultra violet ray stabilized, or chemical resistant.

4. The method of claim 2, further including delivering a fluid to the space with at least one of the plurality of hoses.

5. The method of claim 4, further including controlling a flow of the fluid with the at least one nozzle.

6. The method of claim 2, wherein the partition further includes a coating that is at least one of flame retardant, ultra violet ray stabilized, or chemical resistant.

7. The method of claim 2, wherein at least one of the plurality of hoses is collapsible.

8. The method of claim 2, wherein the fluid is a liquid.

* * * * *